US009349314B2

(12) United States Patent
Park

(10) Patent No.: US 9,349,314 B2
(45) Date of Patent: May 24, 2016

(54) TIME-DIVISIONAL DRIVING ORGANIC ELECTROLUMINESCENCE DISPLAY

(75) Inventor: Sung-Cheon Park, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 920 days.

(21) Appl. No.: 11/328,182

(22) Filed: Jan. 10, 2006

(65) Prior Publication Data

US 2006/0186822 A1 Aug. 24, 2006

(30) Foreign Application Priority Data

Feb. 18, 2005 (KR) ..... 10-2005-0013784

(51) Int. Cl.

| | |
|---|---|
| ***G09G 3/30*** | (2006.01) |
| ***G09G 3/32*** | (2016.01) |
| *G09G 5/02* | (2006.01) |

(52) U.S. Cl.

CPC ..... *G09G 3/3233* (2013.01); *G09G 5/02* (2013.01); *G09G 2300/043* (2013.01); *G09G 2300/0465* (2013.01); *G09G 2300/0804* (2013.01); *G09G 2300/0819* (2013.01); *G09G 2300/0842* (2013.01); *G09G 2300/0861* (2013.01)

(58) Field of Classification Search

USPC ..... 345/36, 42–48, 55, 82, 695, 76; 315/169.1–169.3

See application file for complete search history.

(56) References Cited

U.S. PATENT DOCUMENTS

| | | | | |
|---|---|---|---|---|
| 7,215,313 | B2 * | 5/2007 | Giraldo et al. | 345/98 |
| 2002/0047822 | A1 * | 4/2002 | Senda et al. | 345/90 |
| 2002/0070909 | A1 * | 6/2002 | Asano et al. | 345/76 |
| 2002/0140364 | A1 * | 10/2002 | Inukai | 315/169.3 |
| 2003/0030601 | A1 * | 2/2003 | Komiya | 345/76 |
| 2003/0169218 | A1 * | 9/2003 | Kimura et al. | 345/82 |
| 2003/0189410 | A1 * | 10/2003 | Yamazaki et al. | 315/169.1 |
| 2004/0196239 | A1 * | 10/2004 | Kwon | 345/92 |
| 2004/0233140 | A1 * | 11/2004 | Jo | 345/76 |
| 2004/0239658 | A1 * | 12/2004 | Koyama et al. | 345/204 |
| 2005/0083270 | A1 * | 4/2005 | Miyazawa | 345/76 |
| 2005/0088378 | A1 * | 4/2005 | Ozawa et al. | 345/76 |

FOREIGN PATENT DOCUMENTS

| | | |
|---|---|---|
| JP | 2003-248461 | 9/2003 |
| JP | 2003-288058 | 10/2003 |
| JP | 2004-138827 | 5/2004 |
| KR | 10-2003-0079754 | 10/2003 |

* cited by examiner

*Primary Examiner* — Long D Pham

(74) *Attorney, Agent, or Firm* — H.C. Park & Associates, PLC

(57) ABSTRACT

A time-divisional driving organic electroluminescence display in which a power supply line for supplying a power supply voltage is shared by two pixels coupled with the power supply line, and the power supply line is substantially parallel to and interposed between two data lines installed to drive the two pixels. Each pixel is arranged between a data line and the power supply line.

19 Claims, 8 Drawing Sheets

TIME-DIVISIONAL DRIVING ORGANIC ELECTROLUMINESCENCE DISPLAY

CROSS REFERENCE TO RELATED APPLICATION

This application claims priority to and the benefit of Korean Patent Application No. 10-2005-0013784, filed on Feb. 18, 2005, which is hereby incorporated by reference for all purposes as if fully set forth herein.

BACKGROUND OF THE INVENTION

1. Field of the Invention

The present invention relates to a time-divisional driving organic electroluminescence display with pixels possessing an enhanced aperture ratio due to parallel alignment of the power supply lines and data lines.

2. Discussion of the Background

A time-divisional driving organic electroluminescence display supplies a driving current required for light-emitting action of a plurality of organic light-emitting diodes (OLEDs) through one driving transistor. The driving transistor can be coupled with a plurality of light-emission control transistors, which can each be coupled with an OLED. The light-emission control transistors coupled with the driving transistor are sequentially activated by sequentially transmitted light-emitting control signals, and the plurality of OLEDs emit light sequentially.

FIG. 1 shows a circuit diagram illustrating a time-divisional driving organic electroluminescence display according to the prior art.

Referring to FIG. 1, a red data line 100, a green data line 110 and a blue data line 120 are disposed parallel to each another, and a scan line 130 is disposed to cross the data lines.

A first pixel 140 is arranged near where the red data line 100 and the scan line 130 cross. The first pixel 140 comprises a red driving transistor compensation circuit 147, a red driving transistor TR, a capacitor CR, four light-emission control transistors TRE1, TGE2, TRE3, TGE4, and four OLEDs R1, G2, R3, G4, each coupled with a light-emission control transistor.

A second pixel 150 is arranged near where the green data line 110 and the scan line 130 cross. The second pixel 150 comprises a green driving transistor compensation circuit 157, a green driving transistor TG, a capacitor CG, four light-emission control transistors TBE1, TRE2, TBE3, TRE4, and four OLEDs B1, R2, B3, R4, each coupled with a light-emission control transistor.

A third pixel 160 is arranged near where the blue data line 120 and the scan line 130 cross. The third pixel 160 comprises a blue driving transistor compensation circuit 167, a blue driving transistor TB, a capacitor CB, four light-emission control transistors TGE1, TBE2, TGE3, TBE4, and four OLEDs G1, B2, G3, B4, each coupled with a light-emission control transistor.

The red driving transistor TR and the capacitor CR of the first pixel 140 are commonly coupled with a power supply line ELVDD, and power supply line ELVDD perpendicularly crosses with the red data line 100, which is arranged on a different layer than power supply line ELVDD. Power supply line ELVDD perpendicularly crosses with the green data line 1110 and the blue data line 120, which are both arranged on a different layer than power supply line ELVDD.

When a scan signal SCAN [n] is applied through the scan line 130, the scan signal SCAN [n] is received by the red driving transistor compensation circuit 147, the green driving transistor compensation circuit 157 and the blue driving transistor compensation circuit 167. A switching transistor provided at each driving transistor compensation circuit is turned on.

A red data signal Rdata is applied to a gate terminal of the red driving transistor TR and the capacitor CR through a switching transistor in the turned on red driving transistor compensation circuit 147, and the red data signal Rdata is stored in the capacitor CR. Similarly, a green data signal Gdata, applied through the green data line 110, is stored in the capacitor CG, and a blue data signal Bdata, applied through the blue data line 120, is stored in the capacitor CB.

The input terminal of driving transistor TR is coupled with power supply line ELVDD and the output terminal of driving transistor TR is commonly coupled with four light-emitting control transistors. The gate terminal of each light-emitting control transistor is coupled with light-emitting control signal lines, and the output terminal of each light-emitting control transistor is coupled with an OLED. Driving transistors TG and TB are similarly arranged.

Thus, when a first light-emitting control signal EMI[1] is activated, the light-emitting control transistors TRE1, TBE1, TGE1 are turned on, and the OLEDs R1, B1, G1 begin to emit light.

The light-emitting control transistors TRE1, TBE1, TGE1 are then turned off, and a new red data signal Rdata, a new green data signal Gdata and a new blue data signal Bdata are applied and stored in CR, CG, and CB, respectively. Next, a second light-emitting control signal EMI[2] is activated. The light-emitting control transistors TGE1, TRE2, TBE2 are turned on, and the OLEDs G2, R2, B2 begin to emit light.

The light-emitting control transistors TRE2, TBE2, TGE2 are then turned off, and a new red data signal Rdata, a new green data signal Gdata and a new blue data signal Bdata are applied and stored in CR, CG, and CB, respectively. Next, a third light-emitting control signal EMI[3] is activated. The light-emitting control transistors TGE3, TRE3, TBE3 are turned on, and the OLEDs G3, R3, B3 begin to emit light.

The light-emitting control transistors TRE3, TBE3, TGE3 are then turned off, and a new red data signal Rdata, a new green data signal Gdata and a new blue data signal Bdata are applied and stored in CR, CG, and CB, respectively. Next, a fourth light-emitting control signal EMI[4] is activated. The light-emitting control transistors TGE4, TRE4, TBE4 are turned on, and the OLEDs G4, R4, B4 begin to emit light.

Once all four sets of OLEDs have emitted light in response to applied light-emitting control signals, the above described sequence repeats. As described above, the light-emitting control transistors are sequentially activated, and the organic light-emitting diodes sequentially perform light-emitting actions by the sequentially activated light-emitting control transistors.

According to the foregoing prior art, the plurality of data lines and the power supply line ELVDD are arranged to perpendicularly cross each other. Furthermore, circuit layout may not be easily modified because the ELVDD line perpendicularly crosses the line connecting the driving transistor and the light-emitting control transistor.

Finally, reduction of an aperture ratio results from excess complexity in circuitry wiring. Particularly, the aperture ratio may be significantly reduced in a bottom emission device where a plurality of lines are disposed on the lower layer of the circuitry. Although narrowing a line may prevent the reduction in aperture ratio, the reduced line width may also create diminished transmission efficiency of a signal transmitted through the wiring. Additionally, reduced width of the power supply line ELVDD may result in increasing power noise of an organic electroluminescence display.

SUMMARY OF THE INVENTION

This invention provides a time-divisional driving organic electroluminescence display with a high aperture ratio by arranging power supply lines such that the power supply lines are substantially parallel with data lines.

Additional features of the invention will be set forth in the description which follows, and in part will be apparent from the description, or may be learned by practice of the invention.

The present invention discloses a time-divisional driving organic electroluminescence display comprising a first power supply line that is parallel to a first data line, and a first pixel disposed between a first data line and the first power supply line. Further, the first pixel performs a time-divisional light-emitting operation.

The present invention also discloses a time-divisional driving organic electroluminescence display comprising a plurality of parallel power supply lines for transmitting voltage signals, a plurality of data lines, parallel to the power supply lines, for transmitting data signals, and a plurality of pixels arranged in a matrix. Further, each pixel is coupled with a power supply line to receive a voltage signal, is coupled with a data line to receive a data signal, and generates driving current from the voltage signal and data signal.

The present invention also discloses a time-divisional driving organic electroluminescence display comprising a power supply line that is parallel to a first data line and a second data line, a first pixel positioned between the first data line and the power supply line, and a second pixel disposed between the power supply line and the second data line. Further, the first pixel and second pixel are commonly coupled with the power supply line, and the first pixel and second pixel each perform time-divisional light-emitting operation.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
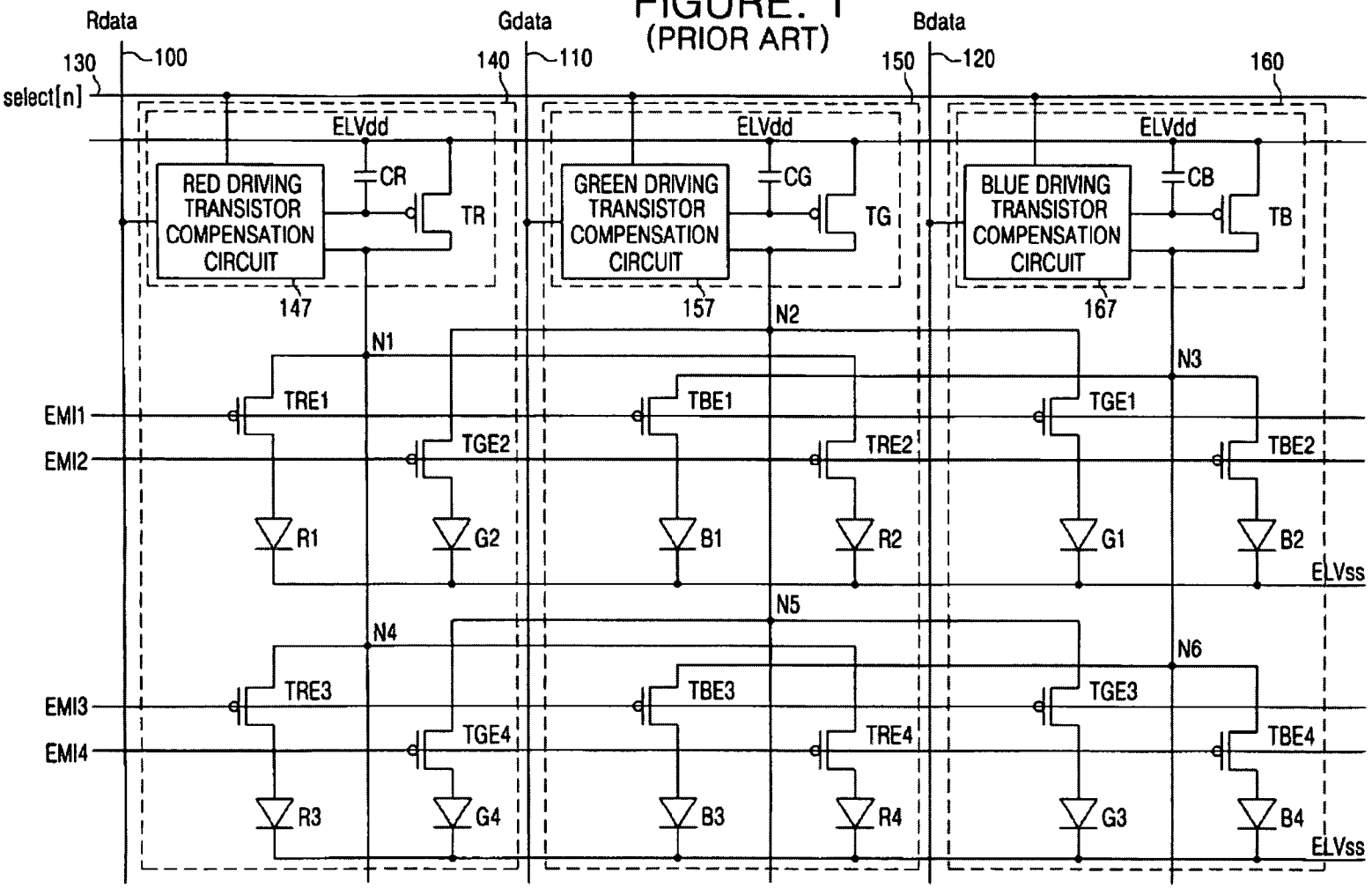
FIGURE. 1 (PRIOR ART)
FIG. 1 shows a circuit diagram illustrating a time-divisional driving organic electroluminescence display according to the prior art.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. For clarity, like numerals refer to like components.

Figure 2:
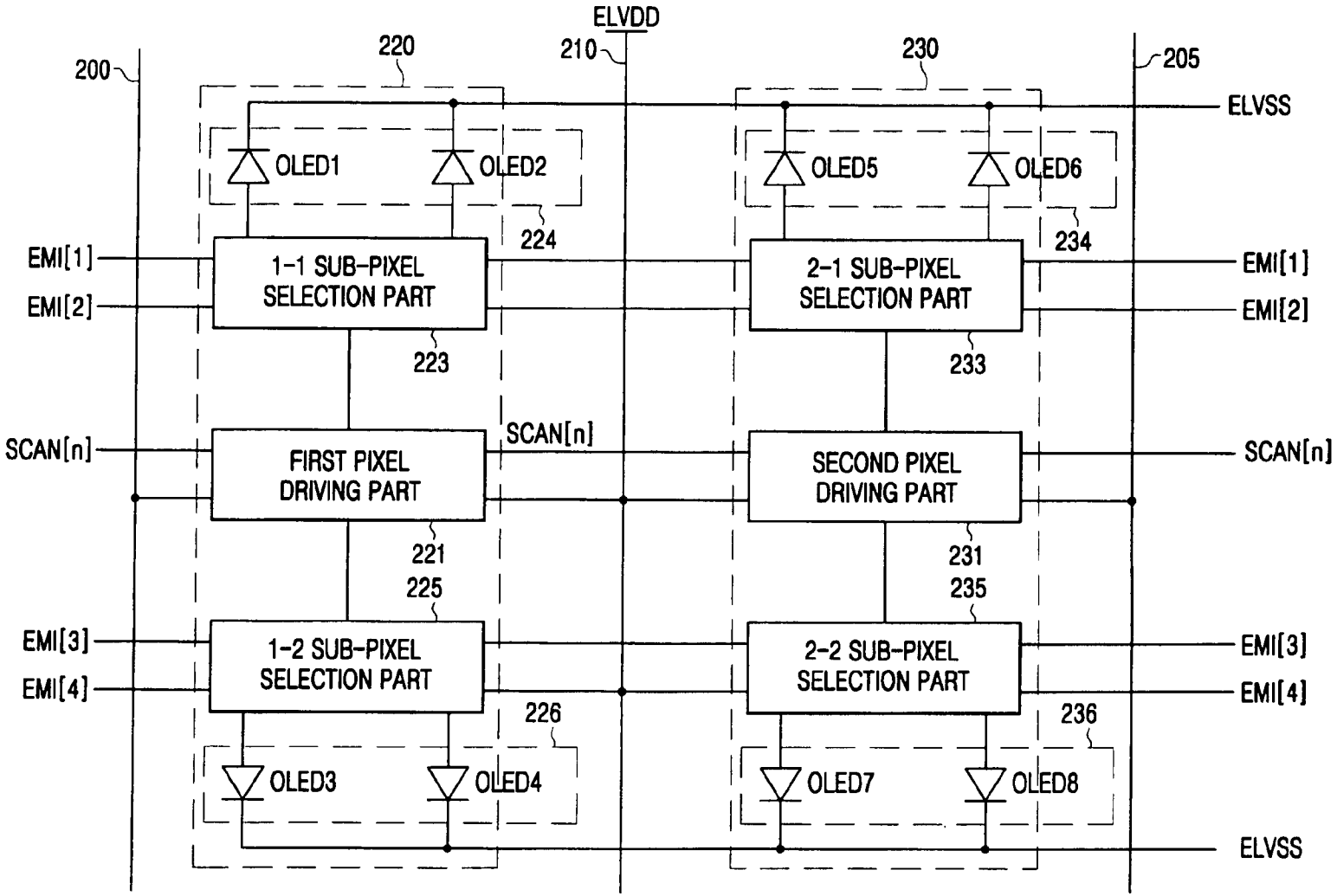
FIG. 2 shows a block diagram illustrating a time-divisional driving organic electroluminescence display according to an embodiment of the present invention.

FIG. 2 shows a circuit diagram illustrating a time-divisional driving organic electroluminescence display according to an embodiment of the present invention.

Referring to FIG. 2, a time-divisional driving organic electroluminescence display according to the present invention includes a first data line 200, a second data line 205 arranged substantially parallel to the first data line 200, a first power supply line 210 arranged substantially parallel to and between the first data line 200 and the second data line 205, a first pixel 220 arranged between the first data line 200 and the first power supply line 210, and a second pixel 230 arranged between the first power supply line 210 and the second data line 205. The first power supply line 210 is coupled with the first pixel 220 and the second pixel 230 to supply positive power supply voltage ELVDD required for the two pixels to generate driving electric current.

The first pixel 220 has a first pixel driving part 221, 1-1 sub-pixel selection part 223, 1-2 sub-pixel selection part 225, 1-1 sub-pixel part 224, and 1-2 sub-pixel part 226.

The 1-1 sub-pixel part 224 is arranged between and coupled with the 1-1 sub-pixel selection part 223 and a second power supply line. The second power supply line supplies a negative power supply voltage ELVSS. The 1-1 sub-pixel part 224 has a first sub-pixel OLED1 and a second sub-pixel OLED2.

The first pixel driving part 221 receives a scan signal SCAN[n] through a scan line, a data signal transmitted through the first data line 200, and electric power from the first power supply line 210. The inputted data signal of the first data line 200 is used to generate driving current in the first pixel driving part 221.

The 1-1 sub-pixel selection part 223 selectively receives driving current generated in the first pixel driving part 221 in response to light-emitting control signals EMI[1] and EMI[2] received by 1-1 sub-pixel selection part 223. The 1-1 sub-pixel selection part 223 then supplies driving current to the first sub-pixel OLED1 or the second sub-pixel OLED2 in 1-1 sub-pixel part 224.

For example, when the light-emitting control signal EMI [1] is activated, the driving current flows to the first sub-pixel OLED 1, and when the light-emitting control signal EMI[2] is activated, the driving current flows to the second sub-pixel OLED2. The number of the light-emitting control signals is determined by the number of sub-pixels coupled with the 1-1 sub-pixel selection part 223. For example, there would be one light-emitting control signal for one sub-pixel, and there would be three light-emitting control signals for three sub-pixels.

The 1-2 sub-pixel selection part 225 selectively receives driving current generated in the first pixel driving part 221 in response to light-emitting control signals EMI[3] and EMI[4] received by 1-2 sub-pixel selection part 225. The 1-2 sub-pixel selection part 225 then supplies driving current to the third sub-pixel OLED3 or the fourth sub-pixel OLED4 in 1-2 sub-pixel part 226.

For example, when the light-emitting control signal EMI [3] is activated, the driving current flows to the third sub-pixel OLED3, and when the light-emitting control signal EMI[4] is activated, the driving current flows to the fourth sub-pixel OLED4. The number of the light-emitting control signals is determined by the number of sub-pixels coupled with the 1-2 sub-pixel selection part 225. For example, there would be one light-emitting control signal for one sub-pixel, and there would be three light-emitting control signals for three sub-pixels.

The second pixel 230 is disposed between the first power supply line 210 and the second data line 205. The second pixel 230 has a second pixel driving part 231, 2-1 sub-pixel selection part 233, 2-2 sub-pixel selection part 235, 2-1 sub-pixel part 234, and 2-2 sub-pixel part 236.

The 2-1 sub-pixel part 234 is arranged between and coupled with the 2-1 sub-pixel selection part 233 and the second power supply line. The 2-1 sub-pixel part 234 has a fifth sub-pixel OLED5 and a sixth sub-pixel OLED6.

The second pixel driving part 231 receives the scan signal SCAN[n]. The scan line that applies scan signal SCAN[n] is coupled with the first pixel driving part 221 and the second pixel driving part 231, and although not shown in FIG. 2, the scan signal SCAN[n] is simultaneously applied to a plurality of pixel driving parts disposed along a horizontal line of a display panel.

The second pixel driving part 231 also receives a data signal transmitted through the second data line 205, and electric power from the first power supply line 210, which is commonly coupled with first pixel driving part 221 and second pixel driving part 231. The inputted data signal of the second data line 205 is used to generate driving current in the second pixel driving part 231.

The 2-1 sub-pixel selection part 233 selectively receives driving current generated in the second pixel driving part 231 in response to light-emitting control signals EMI[1] and EMI [2] received by 2-1 sub-pixel selection part 233. The 2-1 sub-pixel selection part 233 then supplies driving current to the fifth sub-pixel OLED5 or the sixth sub-pixel OLED6 in 2-1 sub-pixel part 234. As described above, the number of the light-emitting control signals is determined by the number of sub-pixels coupled with the 2-1 sub-pixel selection part 233.

Light-emitting control signals EMI[1] and EMI[2] are commonly applied to the 1-1 sub-pixel selection part 223 and the 2-1 sub-pixel selection part 233. Furthermore, although not shown in FIG. 2, the light-emitting control signals EMI[1] and EMI[2] may be commonly applied to a plurality of sub-pixel selection parts disposed along a horizontal row of a display panel.

The 2-2 sub-pixel selection part 235 selectively receives driving current generated in the second pixel driving part 231 in response to light-emitting control signals EMI[3] and EMI [4] received by 2-2 sub-pixel selection part 235. The 2-2 sub-pixel selection part 235 then supplies driving current to the seventh sub-pixel OLED7 or the eighth sub-pixel OLED8 in 2-2 sub-pixel part 236. For example, when the light-emitting control signal EMI[3] is activated, the driving current flows to the seventh sub-pixel OLED7, and when the light-emitting control signal EMI[4] is activated, the driving current flows to the eighth sub-pixel OLED8.

Figure 3:
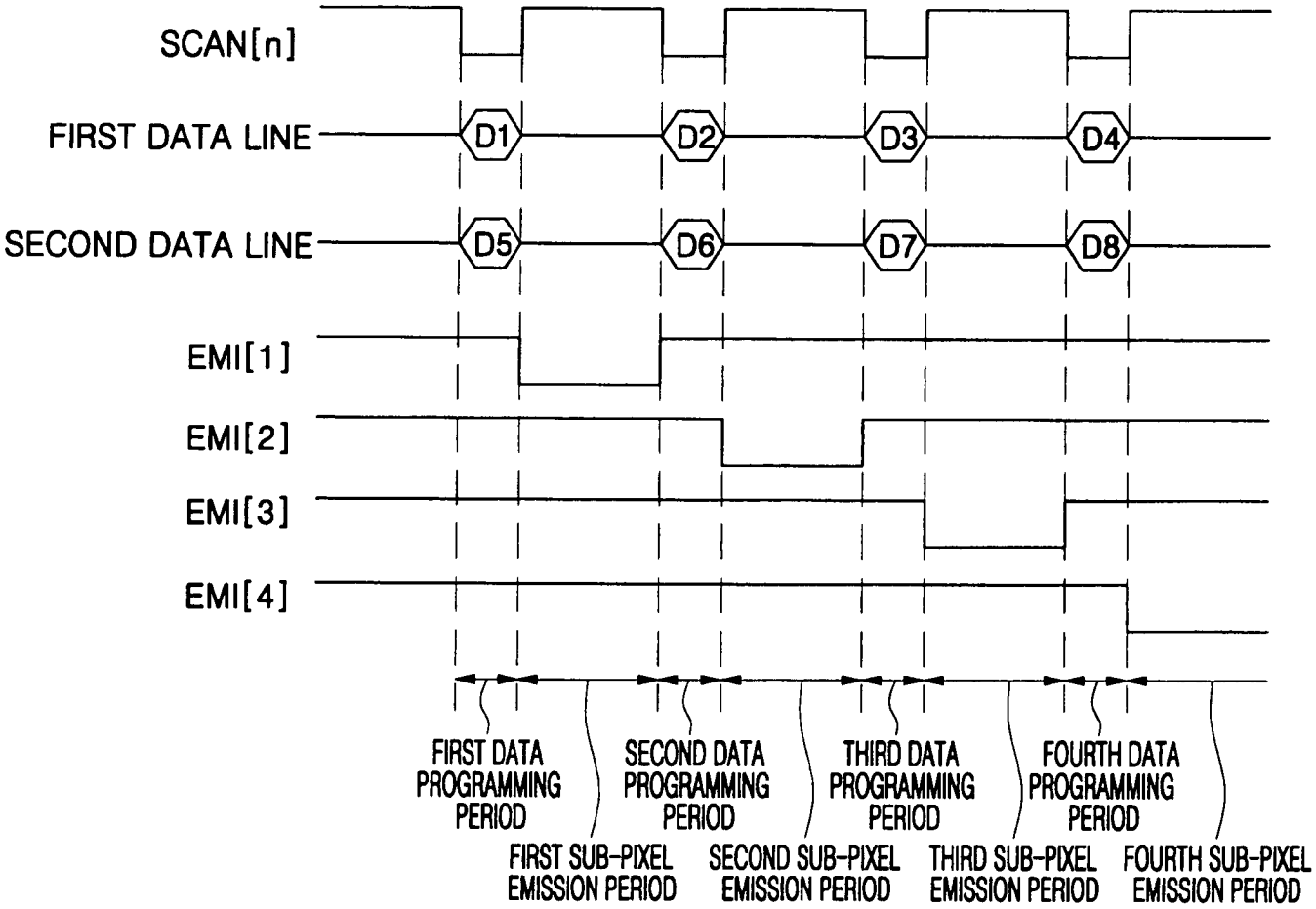
FIG. 3 shows a timing diagram for operation of a time-divisional driving organic electroluminescence display of FIG. 2 according to an embodiment of the present invention.

FIG. 3 is a timing diagram for operation of a time-divisional driving organic electroluminescence display of FIG. 2 according to an exemplary embodiment of the present invention.

Referring to FIG. 3, operation of a plurality of pixels coupled with an n th scan line includes alternating data programming periods and sub-pixel emission periods.

When an nth scan signal SCAN[n] is activated, a first data programming period starts. The first pixel driving part 221 and the second pixel driving part 231 of FIG. 2 are selected by activation of the scan signal SCAN[n]. Additionally, a data signal D1 for OLED1 is applied by first data line 200 and stored in the first pixel driving part. Driving current corresponding to the data signal D1 is generated. A data signal D5 for OLED5 is applied by second data line 205 and stored in the second pixel driving part. Driving current corresponding to the data signal D5 is generated.

When the first data programming period ends, a first sub-pixel emission period begins by the activation of light-emitting control signal EMI[1]. During the first sub-pixel emission period, the 1-1 sub-pixel selection part 223 of FIG. 2 selects driving current generated in the first pixel driving part 221, and supplies the driving current required for a light-emitting operation to the first sub-pixel OLED1. Simultaneously, the 2-1 sub-pixel selection part 233 selects driving current generated in the second pixel driving part 231, and supplies the driving current required for a light-emitting operation to the fifth sub-pixel OLED5. Therefore, the light-emitting control signal EMI[1] simultaneously initiates light emission from first sub-pixel OLED1 and the fifth sub-pixel OLED5.

When the first sub-pixel emission period ends, a second data programming period begins by activation of a scan signal SCAN[n]. The first pixel driving part 221 and the second pixel driving part 231 of FIG. 2 are selected by activation of the scan signal SCAN[n]. Additionally, a data signal D2 for OLED2 is applied by first data line 200 and stored in the first pixel driving part. A data signal D6 for OLED6 is applied by second data line 205 and stored in the second pixel driving part.

When the second data programming period ends, a second sub-pixel emission period starts by the activation of light-emitting control signal EMI[2]. During the second sub-pixel emission period, the 1-1 sub-pixel selection part 223 of FIG. 2 selects driving current generated in the first pixel driving part 221, and supplies the driving current required for a light-emitting operation to the second sub-pixel OLED2. Simultaneously, the 2-1 sub-pixel selection part 233 selects driving current generated in the second pixel driving part 231, and supplies the driving current required for a light-emitting operation to the sixth sub-pixel OLED6. Therefore, the light-emitting control signal EMI[2] simultaneously initiates light emission from second sub-pixel OLED2 and the sixth sub-pixel OLED6.

When the second sub-pixel emission period ends, a third data programming period begins by activation of a scan signal SCAN[n]. The first pixel driving part 221 and the second pixel driving part 231 of FIG. 2 are selected by activation of the scan signal SCAN[n]. Additionally, a data signal D3 for OLED3 is applied by first data line 200 and stored in the first pixel driving part. A data signal D7 for OLED7 is applied by second data line 205 and stored in the second pixel driving part.

When the third data programming period ends, a third sub-pixel emission period begins by the activation of light-emitting control signal EMI[3]. During the third sub-pixel emission period, the 1-1 sub-pixel selection part 223 selects driving current generated in the first pixel driving part 221, and supplies the driving current required for a light-emitting operation to the third sub-pixel OLED3. Simultaneously, the 2-1 sub-pixel selection part 233 selects driving current generated in the second pixel driving part 231, and supplies the driving current required for a light-emitting operation to the seventh sub-pixel OLED7. Therefore, the light-emitting control signal EMI[3] simultaneously initiates light emission from third sub-pixel OLED3 and the seventh sub-pixel OLED7.

When the third sub-pixel emission period ends, a fourth data programming period begins by activation of a scan signal SCAN[n]. The first pixel driving part 221 and the second pixel driving part 231 of FIG. 2 are selected by activation of the scan signal SCAN[n]. Additionally, a data signal D4 for OLED4 is applied by first data line 200 and stored in the first pixel driving part. A data signal D8 for OLED8 is applied by second data line 205 and stored in the second pixel driving part.

When the fourth data programming period ends, a fourth sub-pixel emission period begins by the activation of light-emitting control signal EMI[4]. During the fourth sub-pixel emission period, the 1-1 sub-pixel selection part 223 selects driving current generated in the first pixel driving part 221, and supplies the driving current required for a light-emitting operation to the fourth sub-pixel OLED4. Simultaneously, the 2-1 sub-pixel selection part 233 selects driving current generated in the second pixel driving part 231, and supplies the driving current required for a light-emitting operation to the eighth sub-pixel OLED8. Therefore, the light-emitting control signal EMI[4] simultaneously initiates light emission from fourth sub-pixel OLED4 and the eighth sub-pixel OLED8.

Therefore, sub-pixels sequentially perform light-emitting operation according to light-emitting control signals sequentially applied.

Figure 4:
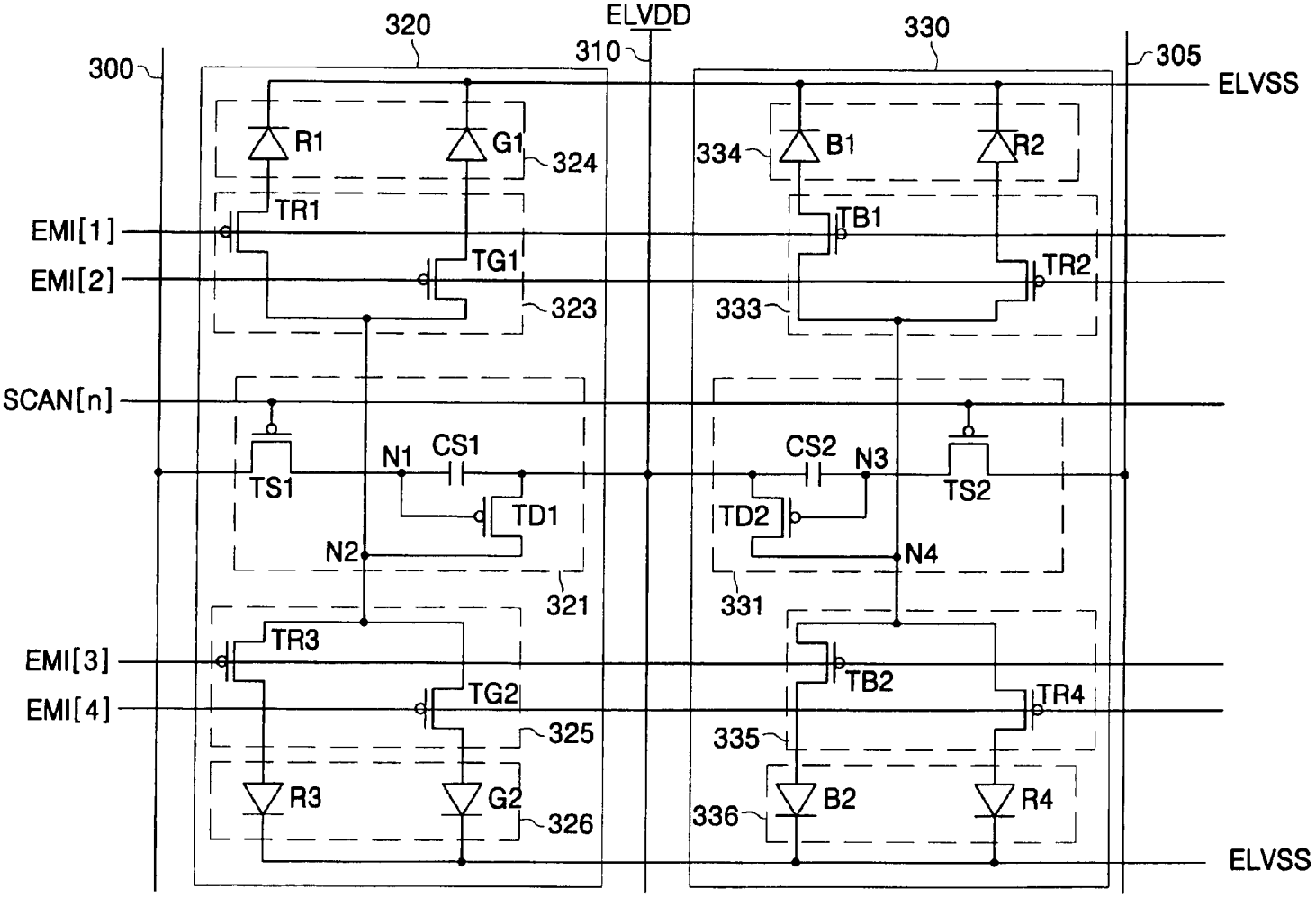
FIG. 4 shows a circuit diagram illustrating a time-divisional driving organic electroluminescence display according to an embodiment of the present invention.

FIG. 4 shows a circuit diagram illustrating a time-divisional driving organic electroluminescence display according to an exemplary embodiment of the present invention.

Referring to FIG. 4, the time-divisional driving organic electroluminescence display has a first data line 300, a second data line 305 substantially parallel to the first data line 300, a first power supply line 310 arranged substantially parallel to and between the first data line 300 and the second data line 305, a first pixel 320 arranged between the first data line 300 and the first power supply line 310, and a second pixel 330 arranged between the first power supply line 310 and the second data line 305, where the first power supply line 310 supplies a positive power supply voltage ELVDD to the first pixel 320 and second-pixel 330.

The first pixel 320 includes a first pixel driving part 321, 1-1 sub-pixel selection part 323, 1-2 sub-pixel selection part 325, 1-1 sub-pixel part 324 coupled with the 1-1 sub-pixel selection part 323, and 1-2 sub-pixel part 326 coupled with the 1-2 sub-pixel selection part 325.

The first pixel driving part 321 has a switching transistor TS1 arranged between and coupled with the first data line 300 and a node N1, a capacitor CS1 arranged between and coupled with the node N1 and the first power supply line 310, and a driving transistor TD1 coupled with a node, located between the first power supply line 310 and capacitor CS1, and a node N2.

The switching transistor TS1 turns on and turns off according to scan signal SCAN[n] coupled with the gate terminal of switching transistor TS1. When the scan signal SCAN[n] is applied as a low-level signal, the switching transistor TS1 is turned on, and a data signal on the first data line 300 is inputted to the node N1 through the turned on switching transistor TS1.

When the data signal is applied to node N1, which is coupled with one terminal of the capacitor CS1, and power supply ELVDD is applied to the other terminal of capacitor CS1, the capacitor CS1 is charged with the voltage difference between the data signal and the power supply ELVDD. Voltage difference applied across the capacitor CS1 is equal to Vsg1, defined as the voltage difference between source and gate of the driving transistor TD1. Therefore, Vsg1 of the driving transistor TD1 stored in the capacitor CS1 determines driving current of the first pixel driving part 321.

The driving transistor TD1 generates driving current corresponding to Vsg1 stored in the capacitor CS1, and supplies the driving current generated to the node N2.

The 1-1 sub-pixel selection part 323 has two light-emitting control transistors TR1 and TG1. The light-emitting control transistor TR1 turns on or turns off according to a light-emitting control signal EMI[1], and the light-emitting control transistor TRI transmits driving current supplied from the node N2 to a first sub-pixel R1 of the 1-1 sub-pixel part 324 when the light-emitting control transistor TRI is turned on. The light-emitting control transistor TG1 turns on or turns off according to a light-emitting control signal EMI[2], and the light-emitting control transistor TG1 transmits the driving current supplied from the node N2 to a second sub-pixel G1 of the 1-1 sub-pixel part 324 when the light-emitting control transistor TG1 is turned on.

The 1-2 sub-pixel selection part 325 has two light-emitting control transistors TR3 and TG2. The light-emitting control transistor TR3 turns on or turns off according to a light-emitting control signal EMI[3], and the light-emitting control transistor TR3 transmits the driving current supplied from the node N2 to a third sub-pixel R3 of the 1-2 sub-pixel part 326 when the light-emitting control transistor TR3 is turned on. The light-emitting control transistor TG2 turns on or turns off according to a light-emitting control signal EMI[4], and the light-emitting control transistor TG2 transmits the driving current supplied from the node N2 to a fourth sub-pixel G2 of the 1-2 sub-pixel part 326 when the light-emitting control transistor TG2 is turned on.

A second pixel 330 disposed between the first power supply line 310 and the second data line 305 has a second pixel driving part 331, 2-1 sub-pixel selection part 333, 2-2 sub-pixel selection part 335, 2-1 sub-pixel part 334 coupled with the 2-1 sub-pixel selection part 333, and 2-2 sub-pixel part 336 coupled with the 2-2 sub-pixel selection part 335.

The second pixel driving part 331 has a switching transistor TS2 arranged between and coupled with the second data line 305 and a node N3, a capacitor CS2 arranged between and coupled with the node N3 and the first power supply line 310, and a driving transistor TD2 coupled with a node, located between the first power supply line 310 and capacitor CS2, and a node N4. The first pixel driving part 321 and the second pixel driving part 331 are commonly coupled with the first power supply line 310.

The switching transistor TS2 turns on and turns off according to scan signal SCAN[n] coupled with the gate terminal of switching transistor TS2. When the scan signal SCAN[n] is applied as a low-level signal, the switching transistor TS2 is turned on, and a data signal on the second data line 305 is inputted to the node N3 through the turned on switching transistor TS2.

When the data signal is applied to node N2, which is coupled with one terminal of the capacitor CS2, and power supply ELVDD is applied to the other terminal of capacitor CS2, the capacitor CS2 is charged with the voltage difference between the data signal and the power supply ELVDD. Voltage difference applied across the capacitor CS2 is equal to Vsg2, defined as the voltage difference between source and gate of the driving transistor TD2. Therefore, Vsg2 of the driving transistor TD2 stored in the capacitor CS2 determines driving current of the second pixel driving part 331.

The driving transistor TD2 generates driving current corresponding to Vsg2 stored in the capacitor CS2, and supplies the driving current to the node N4.

The 2-1 sub-pixel selection part 333 has two light-emitting control transistors TB1 and TR2. The light-emitting control transistor TB1 turns on or turns off according to the light-emitting control signal EMI[1], and the light-emitting control transistor TB1 transmits driving current supplied from the node N4 to a fifth sub-pixel B1 of the 2-1 sub-pixel part 334 when the light-emitting control transistor TB 1 is turned on. The light-emitting control transistor TR2 turns on or turns off according to the light-emitting control signal EMI[2], and the light-emitting control transistor TR2 transmits the driving current supplied from the node N4 to a sixth sub-pixel R2 of the 2-1 sub-pixel part 334 when the light-emitting control transistor TR2 is turned on. Therefore, when the light-emitting control signal EMI[1] is activated in FIG. 4, the first sub-pixel R1 and the fifth sub-pixel B1 simultaneously emit light, and when the light-emitting control signal EMI[2] is activated, the second sub-pixel G1 and the sixth sub-pixel R2 simultaneously emit light.

The 2-2 sub-pixel selection part 335 has two light-emitting control transistors TB2 and TR4. The light-emitting control transistor TB2 turns on or turns off according to the light-emitting control signal EMI[3], and the light-emitting control transistor TB2 transmits the driving current supplied from the node N4 to a seventh sub-pixel B2 of the 2-2 sub-pixel part 336 when the light-emitting control transistor TB2 is turned on. The light-emitting control transistor TR4 turns on or turns off according to the light-emitting control signal EMI[4], and the light-emitting control transistor TR4 transmits the driving current supplied from the node N4 to an eighth sub-pixel R4 of the 2-2 sub-pixel part 336 when the light-emitting control transistor TR4 is turned on. Therefore, when the light-emitting control signal EMI[3] is activated in FIG. 4, the third sub-pixel R3 and the seventh sub-pixel B2 simultaneously emit light and when the light-emitting control signal EMI[4] is activated, the fourth sub-pixel G2 and the eighth sub-pixel R4 simultaneously emit light.

Figure 5A:
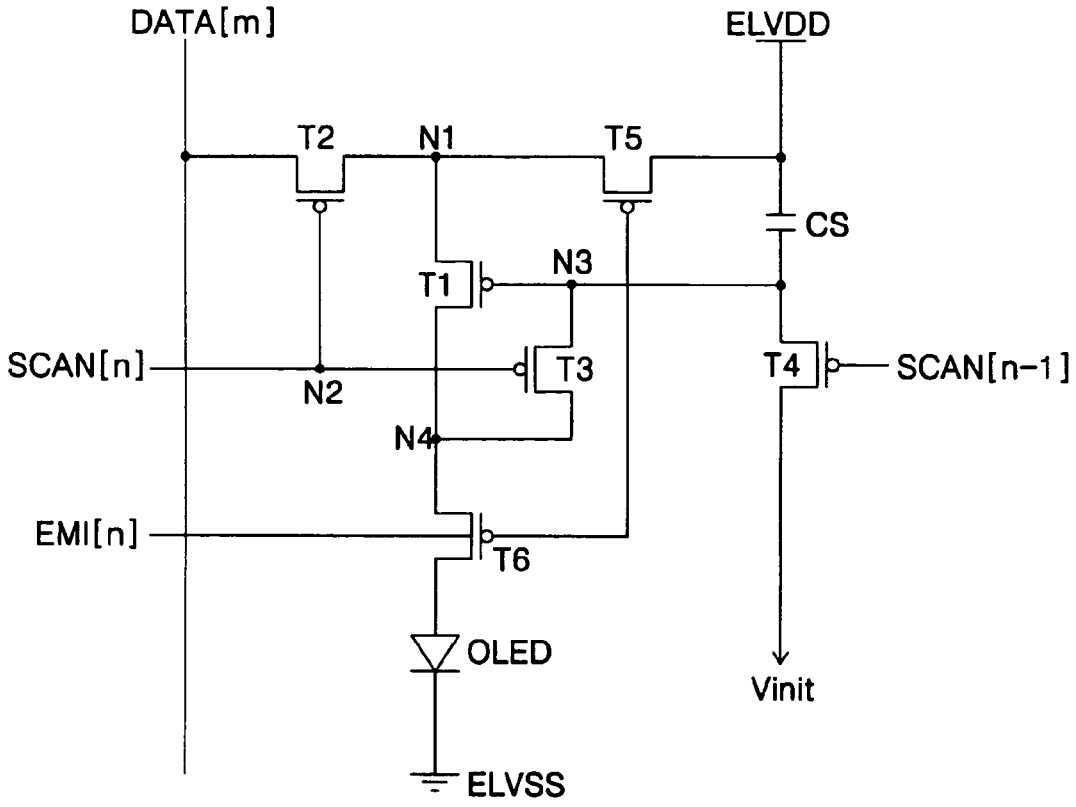
FIG. 5*a* shows a circuit diagram of a pixel circuit applied to a time-divisional driving organic electroluminescence display illustrated in FIG. 2 according to an embodiment of the present invention.

FIG. 5*a* shows a circuit diagram of a pixel circuit applied to a time-divisional driving organic electroluminescence display as illustrated in FIG. 2, according to an embodiment of the present invention.

Referring to FIG. 5*a*, the pixel circuit has six transistors T1, T2, T3, T4, T5 and T6, a capacitor CS and an organic light-emitting diode OLED.

The driving transistor T1 is arranged between and coupled with a node N1 and a node N4, and generates driving current for emission of light from the organic light-emitting diode OLED. A first electrode of the driving transistor T1 is coupled with the node N1, a second electrode of the driving transistor T1 is coupled with the node N4, and the gate of the driving transistor T1 is coupled with a node N3.

A first switching transistor T2 is arranged between and coupled with a data line and the node 1. A first electrode of the first switching transistor T2 is coupled with a data line, a second electrode of the first switching transistor T2 is coupled with the node N1, and a gate of the first switching transistor T2 is coupled a node N2. When a current scan signal SCAN [n] is inputted through the node 2, the first switching transistor T2 is turned on and a data signal DATA[m] is transmitted from the data line through switching transistor T2 to the node N1.

A compensation transistor T3 is arranged between and coupled with the node N3 and the node N4. A first electrode of the compensation transistor T3 is coupled with the node N3, a second electrode of the compensation transistor T3 is coupled with the node N4, and the gate of the compensation transistor T3 is coupled with the node N2. Therefore, the gate of the first switching transistor T2 and a gate of the compensation transistor T3 are commonly coupled with the node N2. When the current scan signal SCAN[n] is applied to node N2, the compensation transistor T3 is turned on. Because there is no potential difference between node N3 and N4 when compensation transistor T3 is turned on, driving transistor T1 is diode-connected.

An initialization transistor T4 is arranged between and coupled with the node N3 and an initialization line to which an initialization voltage Vinit is applied. A first electrode of the initialization transistor T4 is coupled with the node N3, a second electrode of the initialization transistor T4 is coupled to an initialization line, and a previous scan signal SCAN[n−1] is inputted to the gate of the initialization transistor T4. When the previous scan signal SCAN[n−1] is activated, the initialization transistor T4 is turned on, and the initialization voltage Vinit transmitted through the initialization line, is applied to the node N3. The capacitor CS, arranged between and coupled with the node N3 and a first power supply line for supplying a positive power supply voltage ELVDD, is initialized by the initialization voltage Vinit applied to the node N3.

A second switching transistor T5 is arranged between and coupled with the node N1 and the first power supply line. The first electrode of the second switching transistor T5 is coupled with the first power supply line, the second electrode is coupled with the node N1, and the light-emitting control signal EMI[n] is applied to a gate of the second switching transistor T5.

A light-emitting control transistor T6 is arranged between and coupled with the node N4 and an organic light-emitting diode (OLED). The first electrode of the light-emitting control transistor T6 is coupled with the node N4, the second electrode is coupled with the organic light-emitting diode (OLED), and a light-emitting control signal EMI[n] is inputted into a gate of the light-emitting control transistor T6. Therefore, the light-emitting control signal EMI[n] is commonly inputted into the gate of the second switching transistor T5 and the gate of the light-emitting control transistor T6.

Figure 5B:
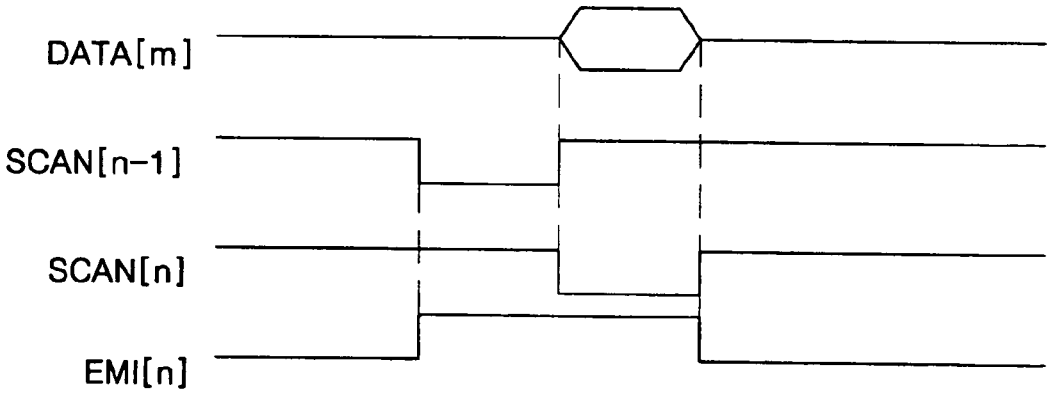
FIG. 5*b* shows a timing diagram for a pixel circuit applied to a time-divisional driving organic electroluminescence display illustrated in FIG. 2 according to preferred embodiment of the present invention.

FIG. 5*b* shows a timing diagram for a pixel circuit applied to a time-divisional driving organic electroluminescence display as illustrated in FIG. 2, according to an embodiment of the present invention.

Referring to FIG. 5*b*, initialization transistor T4 is turned on when a previous scan signal SCAN[n−1] is applied as a low-level signal, and initialization voltage Vinit is applied to a node N3. Voltage ELVDD of first power supply line and an initialization voltage Vinit are applied to opposite terminals of the capacitor CS, which is then initialized and charged with the voltage difference of ELVDD−Vinit.

Subsequently, when the previous scan signal SCAN[n−1] is applied as a high-level signal, the initialization transistor T4 is turned off. Current scan signal SCAN[n] is then applied as a low-level signal, and the first switching transistor T2 and the compensation transistor T3 are turned on. A data signal DATA [m] is transmitted to the node N1 through the turned on first switching transistor T2. The first switching transistor T2 can operate in a triode region so the voltage drop between the first electrode and second electrode of the first switching transistor T2 is approximately zero. Furthermore, when compensation transistor T3 is turned on, driving transistor T1 is substantially diode-connected since a voltage difference between a gate of the driving transistor T1 and the second electrode is approximately 0 V.

When first switching transistor T2 turns on, the data signal DATA[m] is applied to the node N1. Data signal DATA[m] exceeds the threshold voltage of the driving transistor T1, |Vth|, and the voltage at node N4 and N3 becomes DATA[m]−|Vth| because the driving transistor T1 is diode-connected. Therefore, ELVDD and DATA[m]−|Vth| are applied to opposite terminals of the capacitor CS, which is charged with the potential difference between its two terminals.

Next, the current scan signal SCAN[n] is applied at a high level, thus turning off first switching transistor T2 and the compensation transistor T3, and the light-emitting control signal EMI[n] is applied at a low level, thus turning on second switching transistor T5 and the light-emitting control transistor T6. When second switching transistor T5 turns on, positive voltage ELVDD is supplied to node N1. The potential difference between node N1, a source terminal, and the gate terminal of driving transistor T1 drives current to organic light-emitting diode OLED, which initiates light-emitting operation.

A driving current Id flowing through the organic light-emitting diode OLED is calculated according to the following mathematical expression 1:

$$Id=K(Vsg-|Vth|)^2=K(ELVDD-DATA[m]+|Vth|-|Vth|)^2=K(ELVDD-DATA[m])^2 \quad \text{[Mathematical Expression 1]}$$

where K is a constant, Vsg is a voltage value between gate and source of the driving transistor T1, and |Vth| is absolute value of a threshold voltage of the driving transistor T1. Therefore, the influence of threshold voltage Vth of the driving transistor T1 is excluded from the calculation of driving current Id.

Figure 6:
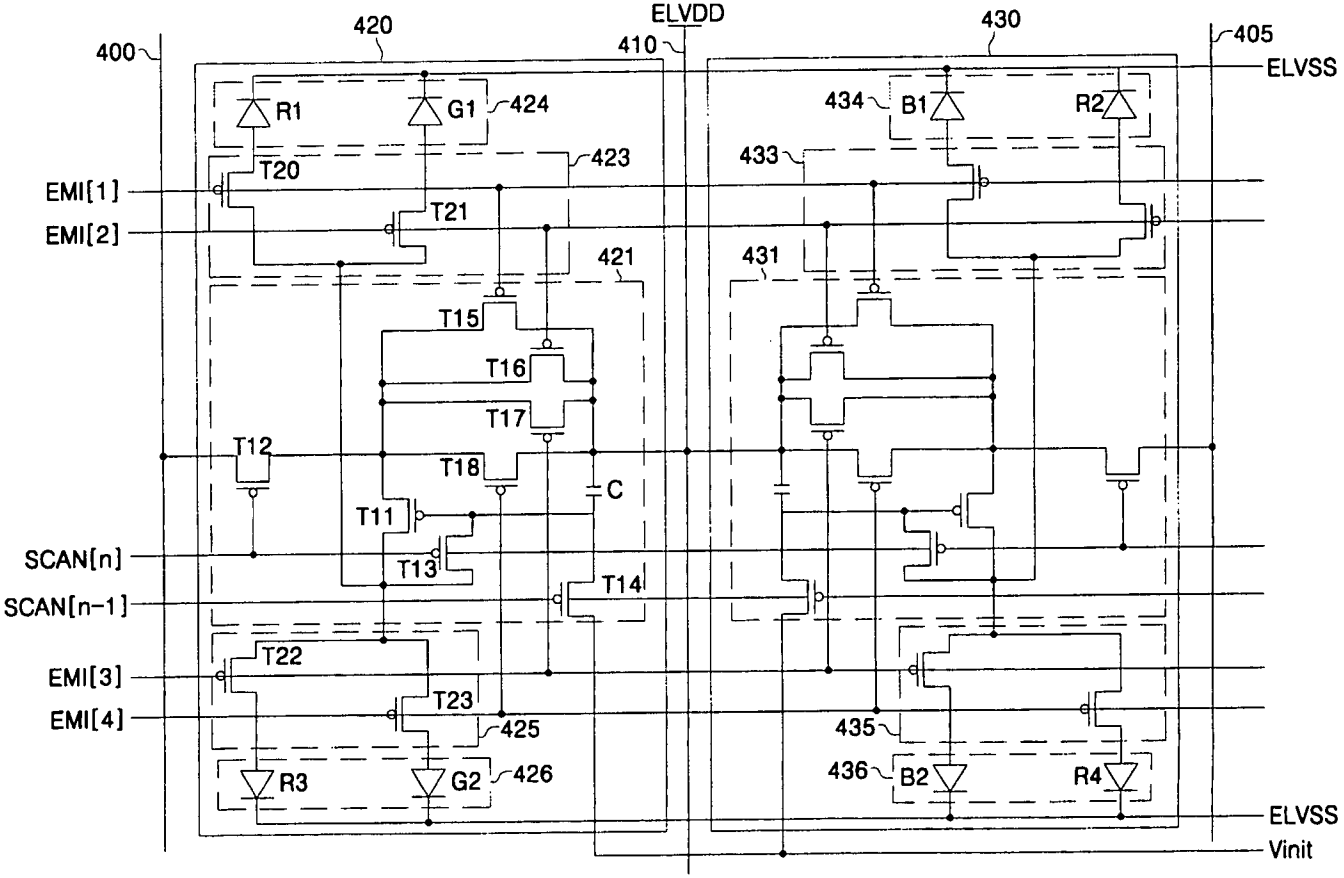
FIG. 6 shows a circuit diagram where a circuit illustrated in FIG. 5*a* is applied to a time-divisional driving organic electroluminescence display illustrated in FIG. 2 according to an embodiment of the present invention.

FIG. 6 shows a circuit diagram where a circuit as illustrated in FIG. 5*a* is applied to a time-divisional driving organic electroluminescence display as illustrated in FIG. 2, according to exemplary embodiment of the present invention.

Referring to FIG. 6, a time-divisional driving organic electroluminescence display uses a pixel circuit as illustrated in FIG. 5*a*. The time-divisional driving organic electroluminescence display illustrated in FIG. 6 has first pixel 420 disposed between first data line 400 and first power supply line 410, and second pixel 430 disposed between the first power supply line 410 and second data line 405. The first power supply line 410 is commonly coupled with the first pixel 420 and the second pixel 430. In FIG. 6, a positive power supply voltage ELVDD is supplied through the first power supply line 410.

The first pixel 420 has first pixel driving part 421, 1-1 sub-pixel selection part 423, 1-1 sub-pixel part 424, 1-2 sub-pixel selection part 425, and 1-2 sub-pixel part 426.

The first pixel driving part 421, comprising the driving circuit as illustrated in FIG. 5*a*, performs an initialization operation according to control of a previous scan signal SCAN[n−1] and receives a data signal from the first data line 400. Furthermore, the first pixel driving part 421 generates driving current corresponding to a data signal received from the first data line 400. The driving current of the first pixel driving part 421 is driven by a positive power supply voltage ELVDD supplied through the first power supply line 410.

The 1-1 sub-pixel selection part 423 is disposed between first pixel driving part 421 and 1-1 sub-pixel part 424, and controls light-emitting operation of the 1-1 sub-pixel part 424 according to first light-emitting control signal EMI[1] and second light-emitting control signal EMI[2].

The 1-1 sub-pixel part 424 is disposed between the 1-1 sub-pixel selection part 423 and second power supply line for supplying a negative power supply voltage ELVSS and includes first sub-pixel R1 and second sub-pixel G1. When the first light-emitting control signal EMI[1] is activated, the first sub-pixel R1 performs a light-emitting operation, and when the second light-emitting control signal EMI[2] is activated, the second sub-pixel G1 performs a light-emitting operation.

The 1-2 sub-pixel selection part 425 is disposed between first pixel driving part 421 and 1-2 sub-pixel part 426, and controls a light-emitting operation of the 1-2 sub-pixel part 426 by a third light-emitting control signal EMI[3] and a fourth light-emitting control signal EMI[4].

The 1-2 sub-pixel part 426 is disposed between the 1-2 sub-pixel selection part 425 and the second power supply line for supplying the negative power supply voltage ELVSS and includes third sub-pixel R3 and fourth sub-pixel G2. When the third light-emitting control signal EMI[3] is activated, the third sub-pixel R3 performs a light-emitting operation, and when the fourth light-emitting control signal EMI[4] is activated, the fourth sub-pixel G2 performs a light-emitting operation.

As described in FIG. 5*a* and FIG. 5*b*, when a previous scan signal SCAN[n−1] is activated, an initialization transistor T14 is turned on, and a capacitor C is initialized with the voltage difference across the terminals, ELVDD-Vinit.

When the current scan signal SCAN[n] is applied, a first switching transistor T12 and a compensation transistor T13 are turned on. A data signal is applied to a driving transistor T11 from the first data line 400 through the first switching transistor T12, and the data signal is stored in the capacitor C.

When the first light-emitting control signal EMI[1] is activated, second switching transistor T15 and first light-emitting control transistor T20 in 1-1 sub-pixel selection part 423 are turned on, and driving current corresponding to a data signal stored in the capacitor C is generated. The generated driving electric current flows to the first sub-pixel R1, and the first sub-pixel R1 initiates light-emitting operation.

After the first sub-pixel R1 performs the light-emitting operation in response to application of the first light-emitting control signal EMI[1], an initialization operation for light-emission of the second sub-pixel G1, inputting and storage of the data signal are carried out as described above. Then, an activation operation of the second light-emitting control signal EMI[2] are sequentially carried out, where application of second light-emitting control signal EMI[2] turns on a third switching transistor T16 and a second light-emitting control transistor T21, and second sub-pixel G1 initiates light-emitting operation.

The third sub-pixel R3 and fourth sub-pixel G2 then sequentially initiate light-emitting operation as described for first sub-pixel R1 and second sub-pixel G1 as described above. Specifically, application of third light-emitting control signal EMI[3] turns on a fourth switching transistor T17 and a third light-emitting control transistor T22, and third sub-pixel R3 initiates light-emitting operation. Finally, application of fourth light-emitting control signal EMI[4] turns on a fifth switching transistor T18 and a fourth light-emitting control transistor T23, and fourth sub-pixel G2 initiates light-emitting operation.

The second pixel 430, arranged between the first power supply line 410 and the second data line 405, has second pixel driving part 431, 2-1 sub-pixel selection part 433, 2-1 sub-pixel part 434, 2-2 sub-pixel selection part 435, and 2-2 sub-pixel part 436.

The second pixel driving part 431, comprising the driving circuit as illustrated in FIG. 5*a*, performs an initialization operation according to control of the previous scan signal SCAN[n−1] and receives a data signal from the second data line 405 according to the current scan signal SCAN[n]. Furthermore, the second pixel driving part 431 generates driving current corresponding to the data signal received from the second data line 405. The driving current of the second pixel driving part 431 is driven by a positive power supply voltage ELVDD supplied through the first power supply line 410.

The 2-1 sub-pixel selection part 433 is disposed between second pixel driving part 431 and 2-1 sub-pixel part 434, and controls light-emitting operation of the 2-1 sub-pixel part 434 according to the first light-emitting control signal EMI[1] and the second light-emitting control signal EMI[2].

The 2-1 sub-pixel part 434 is disposed between the 2-1 sub-pixel selection part 433 and second power supply line for supplying a negative power supply voltage ELVSS and includes fifth sub-pixel B1 and sixth sub-pixel R2. When the first light-emitting control signal EMI[1] is activated, the fifth sub-pixel B1 performs a light-emitting operation, and when the second light-emitting control signal EMI[2] is activated, the sixth sub-pixel R2 performs a light-emitting operation.

The 2-2 sub-pixel selection part 435 is disposed between second pixel driving part 431 and 2-2 sub-pixel part 436, and controls a light-emitting operation of the 2-2 sub-pixel part 436 according to the third light-emitting control signal EMI [3] and the fourth light-emitting control signal EMI[4].

The 2-2 sub-pixel part 436 is disposed between the 2-2 sub-pixel selection part 435 and the second power supply line for supplying the negative power supply voltage ELVSS, and includes seventh sub-pixel B2 and eighth sub-pixel R4. When the third light-emitting control signal EMI[3] is activated, the seventh sub-pixel B2 performs a light-emitting action, and when the fourth light-emitting control signal EMI[4] is activated, the eighth sub-pixel R4 performs a light-emitting operation.

The driving circuit of the second pixel driving part 431 is disposed symmetrical to circuit of the first pixel driving part 421 of the first pixel and the first power supply line 410. Therefore, initialization operation by a previous scan signal SCAN[n−1], inputting and storing of a data signal through second data line by a current scan signal SCAN[n], and initiation of light-emitting operation of a sub-pixel according to a light-emitting control signal are performed by the same principle as described in the first pixel.

Thus, the fifth sub-pixel B1, sixth sub-pixel R2, seventh sub-pixel B2 and eighth sub-pixel R4 sequentially initiate light-emitting operation as described for first sub-pixel R1, second sub-pixel G1, third sub-pixel R3, and fourth sub-pixel G2 in first pixel 420 above.

Figure 7:
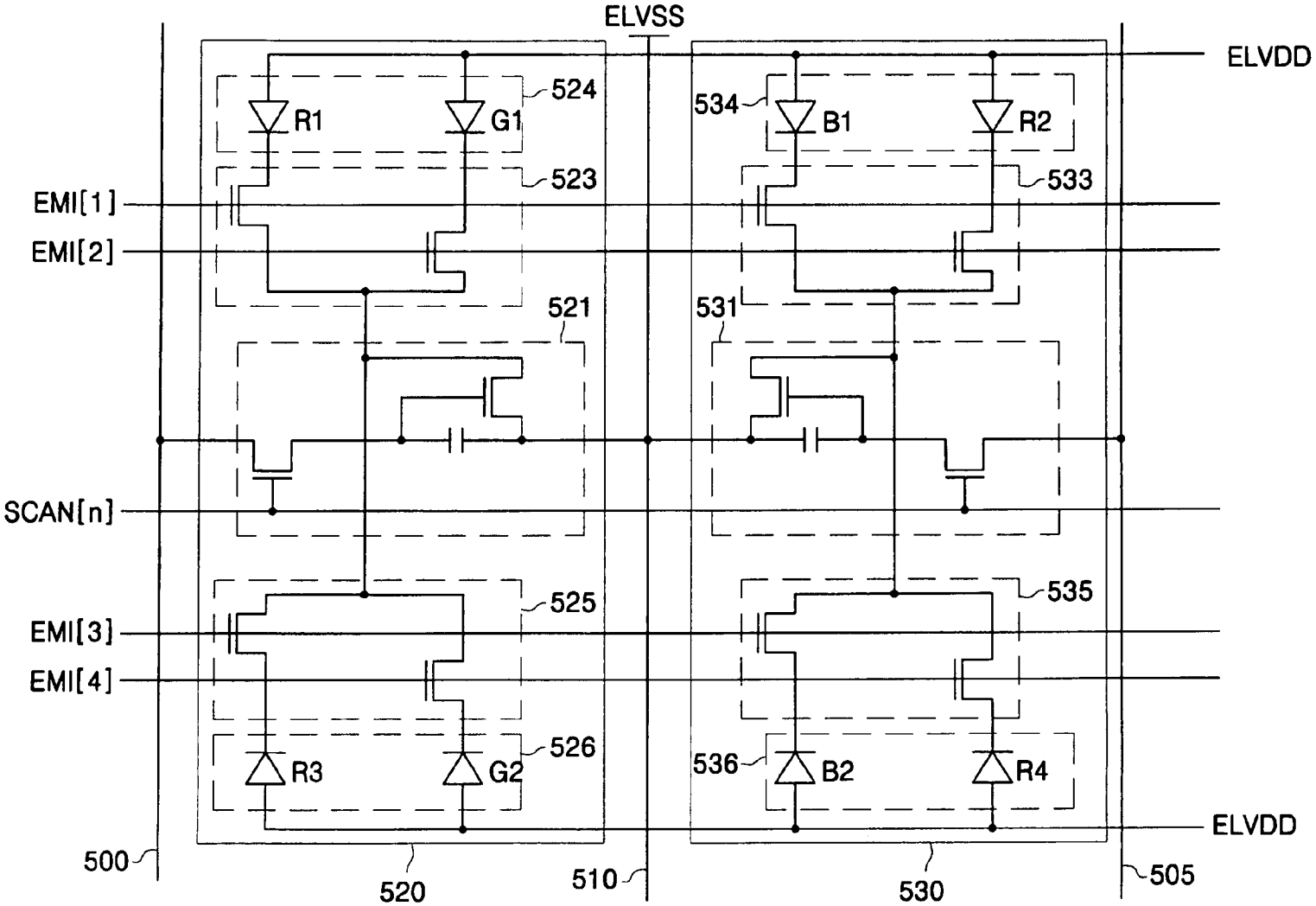
FIG. 7 shows a circuit diagram where an organic electroluminescence display illustrated in FIG. 4 is configured with NMOS transistors according to an embodiment of the present invention.

FIG. 7 shows a circuit diagram where an organic electroluminescence display as illustrated in FIG. 4 is configured with NMOS transistors, according to exemplary embodiment of the present invention.

Referring to FIG. 7, connections between various components of the organic electroluminescence display and operation thereof is the same as described in FIG. 4 with the following modifications. The transistors comprising the organic electroluminescence display shown in FIG. 4 are PMOS transistors, and the transistors comprising the organic electroluminescence display shown in FIG. 7 are NMOS transistors. Furthermore, first power supply line 510 is disposed between first data line 500 and second data line 505 as shown in FIG. 7, and supplies a negative power supply voltage ELVSS to a first pixel 520 and a second pixel 530.

The first pixel 520, having NMOS transistors and arranged between the first data line 500 and the first power supply line 510, has first pixel driving part 521, 1-1 sub-pixel selection part 523, 1-1 sub-pixel part 524, 1-2 sub-pixel selection part 525, and 1-2 sub-pixel part 526.

The second pixel 530, having NMOS transistors and arranged between the first power supply line 510 and the second data line 505, has second pixel driving part 531, 2-1 sub-pixel selection part 533, 2-1 sub-pixel part 534, 2-2 sub-pixel selection part 535 and 2-2 sub-pixel part 536.

The first pixel driving part 521, comprising the driving circuit as illustrated in FIG. 4, stores a first data signal transmitted through the first data line 500 according to a scan signal SCAN[n] and generates driving current corresponding to the first data signal. Similarly, the second pixel driving part 531, also comprising the driving circuit as illustrated in FIG. 4, stores a second data signal transmitted through the second data line 505 according to a scan signal SCAN[n] and generates driving current corresponding to the second data signal.

Because the transistors shown in FIG. 7 are NMOS type, light-emitting operation is activated by high-level light-emitting control signals. Thus, when the light-emitting control signal EMI[1] has a high level, the first sub-pixel R1 and the fifth sub-pixel B1 perform light-emitting operation at the same time. When the light-emitting control signal EMI[2] has a high level, the second sub-pixel G2 and the sixth sub-pixel R2 perform light-emitting operation at the same time. When the light-emitting control signal EMI[3] has a high level, the third sub-pixel R3 and the seventh sub-pixel B2 perform light-emitting operation at the same time. When the light-emitting control signal EMI[4] has a high level, the fourth sub-pixel G4 and the eighth sub-pixel R4 perform light-emitting operation at the same time. Finally, light-emitting operation of the sub-pixels in such sequential order may be repeated.

Figure 8:
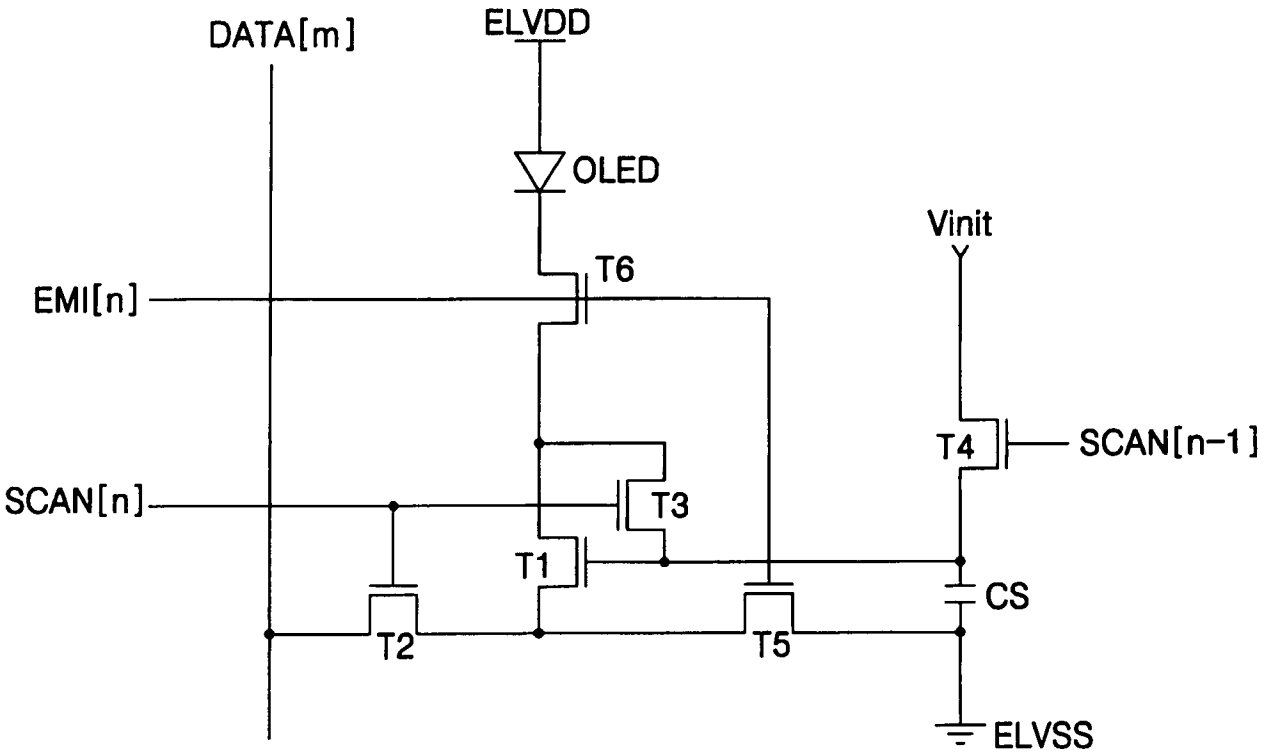
FIG. 8 shows a circuit diagram in which a pixel circuit illustrated in FIG. 5*a* is configured with NMOS transistors according to an embodiment of the present invention.

FIG. 8 shows a circuit diagram in which a pixel circuit as illustrated in FIG. 5*a* is configured with NMOS transistors according to exemplary embodiment of the present invention.

Referring to FIG. 8, since respective transistors compose NMOS transistors rather than PMOS transistors, signals for controlling the NMOS transistors have a reversed shape compared with a case of FIG. 5*b*.

Specifically, operation of the pixel circuit shown in FIG. 7 is as follows. When a previous scan signal SCAN[n−1] is a high-level signal, a transistor T4 is turned on, and the capacitor CS is initialized by applying Vinit to one terminal of capacitor CS through the turned on transistor T4. Therefore, capacitor CS is charged with potential difference of Vinit-ELVSS.

Subsequently, when a current scan signal SCAN[n] is a high-level signal, first switching transistor T2 and compensation transistor T3 are turned on. A data signal DATA[m] is transmitted to the driving transistor T1, and the driving transistor T1 is diode-connected. Therefore, voltage of DATA [m]−|Vth| is applied to a gate of the driving transistor T1 and one terminal of the capacitor CS.

When the light-emitting control signal EMI[n] is changed to a high-level signal, second switching transistor T5 and light-emitting control transistor T6 are turned on. Driving current flows through the light-emitting control transistor T6 to an organic light-emitting diode OLED, which emits light. The driving current flowing to the OLED is determined by the following mathematical expression 2:

$$Id=K(Vsg-|Vth|)^2=K(ELVSS-DATA[m]+|Vth|-|Vth|)^2=K(ELVSS-DATA[m])^2 \quad \text{[Mathematical Expression 2]}$$

where K is a constant, Vsg is a voltage difference between gate and source of the driving transistor T1, and Vth is a threshold voltage of the driving transistor T1. Therefore, influence of Vth, the threshold voltage of the driving transistor T1, is excluded from the calculation for the driving current Id.

When a pixel circuit illustrated in FIG. 8 is applied to the first pixel driving part 521 and second pixel driving part 531 of an organic electroluminescence display illustrated in FIG. 7, first power supply line for supplying a negative power supply voltage ELVSS is interposed between and coupled with first pixel 520 and second pixel 530.

According to the present invention as described in the above, aperture ratio of the pixels is enhanced by disposing a power supply line between two pixels and constructing the power supply line such that the power supply line is substantially parallel to the data lines.

According to the foregoing present invention, the power supply line commonly coupled with the two pixels is arranged such that the power supply line is substantially parallel to the data lines for applying data signals to the respective pixels. Therefore, aperture ratio of the pixels is enhanced, and layout of circuits of the pixels is capable of being performed without reduction of line width of the power supply line.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A time-divisional driving organic electroluminescence display, comprising:

a first power supply line that is arranged substantially parallel to a first data line;

a first pixel arranged between the first data line and the first power supply line, the first pixel comprising a first sub-pixel selection part, a second sub-pixel selection part, and a first pixel driving part; and a second pixel arranged between the first power supply line and a second data line, the second data line being the data line closest to the first data line, wherein the first power supply line is arranged between the first data line and the second data line, wherein the first pixel driving part is coupled with the first sub-pixel selection part and the second sub-pixel selection part, wherein the first pixel driving part comprises:

a first capacitor configured to receive and store a first data signal and a second data signal from the first data line;

a first driving element configured to:

receive a first power from the first power supply line;

generate a first driving current in response to the first data signal stored in the first capacitor, and a second driving current in response to the second data signal stored in the first capacitor, respectively; and transmit the first driving current to the first sub-pixel selection part, and the second driving current to the second sub-pixel selection part, respectively, wherein the first sub-pixel selection part is configured to receive the first driving current from the first pixel driving part, and supply the first driving current to one of at least two organic light-emitting diodes included in the first pixel, and wherein the second sub-pixel selection part is configured to receive the second driving current from the first pixel driving part, and supply the second driving current to another of the at least two organic light-emitting diodes included in the first pixel time-divisionally.

2. The time-divisional driving organic electroluminescence display of claim 1, wherein the first pixel further comprises:

a first sub-pixel part, coupled with the first pixel driving part and a second power supply line, the first sub-pixel part receiving the first driving current and performing a time-divisional light-emitting operation.

3. The time-divisional driving organic electroluminescence display of claim 2, wherein the first sub-pixel selection part is arranged between and coupled with the first pixel driving part and the first sub-pixel part, the first sub-pixel selection part receiving a first light-emitting control signal and transmitting the first driving current from the first pixel driving part to the first sub-pixel part in response to the first light-emitting control signal.

4. The time-divisional driving organic electroluminescence display of claim 3, wherein the first pixel further comprises:

a second sub-pixel part coupled with the first pixel driving part and a second power supply line, the second sub-pixel part receiving the first driving current and performing a time-divisional light-emitting operation, wherein the second sub-pixel selection part is arranged between and coupled with the first pixel driving part and the second sub-pixel part, the second sub-pixel selection part receiving a second light-emitting control signal and transmitting the first driving current from the first pixel driving part to the second sub-pixel part in response to the second light-emitting control signal.

5. The time-divisional driving organic electroluminescence display of claim 3, wherein the first power supply line supplies a positive voltage, and the second power supply line supplies a negative voltage.

6. The time-divisional driving organic electroluminescence display of claim 3, wherein the first power supply line supplies a negative voltage, and the second power supply line supplies a positive voltage.

7. The time-divisional driving organic electroluminescence display of claim 3, wherein the first sub-pixel part and the second sub-pixel part each comprise an organic light-emitting diode.

8. The time-divisional driving organic electroluminescence display of claim 3, wherein the first sub-pixel selection part comprise light-emitting control transistors equal in number to a number of light-emitting control signals received by the first sub-pixel selection part during a sub-pixel emission period.

9. The time-divisional driving organic electroluminescence display of claim 8, wherein a number of organic light-emitting diodes in the first sub-pixel part is equal in number to a number of light-emitting control transistors in the first sub-pixel selection part.

10. The time-divisional driving organic electroluminescence display of claim 2, wherein the first pixel driving part further comprises:

a first switching transistor, coupled with the first data line, configured to transmit the first data signal in response to a first scan signal and the second data signal in response to a second scan signal, and wherein the first driving element comprises a first driving transistor.

11. The time-divisional driving organic electroluminescence display of claim 2, wherein the first driving element comprises:

a first switching transistor configured to receive the first data signal in response to a first scan signal;

a driving transistor configured to generate the first driving current according to the first data signal;

a compensation transistor configured to diode-connect the driving transistor in response to the first scan signal;

a second switching transistor configured to supply the first power to the driving transistor in response to a light-emitting control signal; and an initialization transistor configured to initialize a voltage applied to the capacitor according to a previous scan signal.

12. The time-divisional driving organic electroluminescence display of claim 11, wherein the first power supply line supplies a negative voltage, and the second power supply line supplies a positive voltage.

13. The time-divisional driving organic electroluminescence display of claim 11, wherein the first power supply line supplies a positive voltage, and the second power supply line supplies a negative voltage.

14. The time-divisional driving organic electroluminescence display of claim 1, wherein the first pixel and the second pixel are coupled with the first power supply line.

15. The time-divisional driving organic electroluminescence display of claim 14, wherein the second pixel comprises:

a second pixel driving part for receiving a second data signal from the second data line and the first power to generate a second driving current;

a third sub-pixel part comprising an organic light-emitting diode;

a third sub-pixel selection part, arranged between and coupled with the second pixel driving part and the third sub-pixel part, for receiving the first light-emitting control signal and transmitting the second driving current from the second pixel driving part to the third sub-pixel part in response to the first light-emitting control signal;

a fourth sub-pixel part comprising an organic light-emitting diode; and a fourth sub-pixel selection part arranged between and coupled with the second pixel driving part and a fourth sub-pixel part, for receiving the second light-emitting control signal and transmitting the second driving current from the second pixel driving part to the fourth sub-pixel part in response to the second light-emitting control signal.

16. The time-divisional driving organic electroluminescence display of claim 1, wherein the at least two organic light-emitting diodes do not emit light at the same time.

17. The time-divisional driving organic electroluminescence display of claim 1, wherein the first pixel driving part receives the first data signal from the first data line while a first scan signal is applied to a first scan line and receives the second data signal from the first data line while a second scan signal is applied to the first scan line.

18. A time-divisional driving organic electroluminescence display, comprising:

a plurality of power supply lines for transmitting a first power;

a plurality of data lines, arranged substantially parallel to the plurality of power supply lines, for transmitting data signals; and a plurality of pixels, wherein a first pixel is coupled with a first power supply line to receive the first power, is coupled with a first data line to receive a first data signal and a second data signal, and generates a first driving current corresponding to the first power and the first data signal and a second driving current corresponding to the first power and the second data signal, wherein a second pixel is coupled with the first power supply line to receive the first power, is coupled with a second data line to receive a third data signal, and generates a third driving current corresponding to the first power and the third data signal, wherein the first power supply line is arranged between the first data line and the second data line, wherein the first pixel comprises a first sub-pixel selection part, a second sub-pixel selection part, and a first pixel driving part, wherein the first pixel driving part is coupled with the first sub-pixel selection part and the second sub-pixel selection part, the first pixel driving part comprising:

a first capacitor configured to receive and store a first data signal and a second data signal from the first data line;

a first driving element configured to:

receive a first power from the first power supply line;

generate a first driving current in response to the first data signal stored in the first capacitor, and a second driving current in response to the second data signal stored in the first capacitor, respectively; and transmit the first driving current to the first sub-pixel selection part, and the second driving current to the second sub-pixel selection part, respectively, wherein the first sub-pixel selection part is configured to receive the first driving current from the first pixel driving part, and supply the first driving current to one of at least two organic light-emitting diodes included in the first pixel, and wherein the second sub-pixel selection part is configured to receive the second driving current from the first pixel driving part, and supply the second driving current to another of the at least two organic light-emitting diodes included in the first pixel time-divisionally.

19. A time-divisional driving organic electroluminescence display, comprising:

a power supply line arranged substantially parallel to a first data line and a second data line;

a first pixel arranged between the first data line and the power supply line; and a second pixel arranged between the power supply line and the second data line, wherein the first pixel and the second pixel are coupled with the power supply line, wherein the power supply line is arranged between the first data line and the second data line, wherein the first pixel comprises a first sub-pixel selection part, a second sub-pixel selection part, and a first pixel driving part, wherein the first pixel driving part is coupled with the first sub-pixel selection part and the second sub-pixel selection part, wherein the first pixel driving part comprises:

a first capacitor configured to receive and store a first data signal and a second data signal from the first data line;

a first driving element configured to:

receive a first power from the power supply line;

generate a first driving current in response to the first data signal stored in the first capacitor, and a second driving current in response to the second data signal stored in the first capacitor, respectively; and transmit the first driving current to the first sub-pixel selection part, and the second driving current to the second sub-pixel selection part, respectively, wherein the first sub-pixel selection part is configured to receive the first driving current from the first pixel driving part, and supply the first driving current to one of at least two organic light-emitting diodes included in the first pixel, and wherein the second sub-pixel selection part is configured to receive the second driving current from the first pixel driving part, and supply the second driving current to another of the at least two organic light-emitting diodes included in the first pixel time-divisionally.

* * * * *